US005517936A

United States Patent [19]

Mennucci et al.

[11] Patent Number: 5,517,936

[45] Date of Patent: *May 21, 1996

[54] TAUTLINE BOAT MOORING SYSTEM

[75] Inventors: Robert J. Mennucci; Gary F. Loverich, both of Bainbridge Island, Wash.

[73] Assignee: Ocean Spar Technologies L L C., Bainbridge Island, Wash.

[ * ] Notice: The term of this patent shall not extend beyond the expiration date of Pat. No. 5,398,633.

[21] Appl. No.: 375,538

[22] Filed: Jan. 19, 1995

Related U.S. Application Data

[63] Continuation-in-part of Ser. No. 198,185, Feb. 17, 1994, Pat. No. 5,398,633.

[51] Int. Cl.[6] ..... B63B 21/00

[52] U.S. Cl. ..... 114/230; 114/293

[58] Field of Search ..... 114/293, 241, 114/230, 240 E, 263; 441/3, 23, 28, 21, 1, 4, 5; 405/60, 63, 66, 70, 72

[56] References Cited

U.S. PATENT DOCUMENTS

| | | | |
|---|---|---|---|
| 1,292,755 | 1/1919 | Geraghty | 114/241 |
| 3,138,135 | 6/1964 | Langer | 114/230 |
| 3,464,214 | 9/1969 | King | 114/230 |
| 3,703,151 | 11/1972 | Clement | 114/230 |
| 4,155,673 | 5/1979 | Yashima | 114/293 |
| 4,174,186 | 11/1979 | Kasal et al. | 405/63 |
| 4,248,547 | 2/1981 | Brown | 405/72 |
| 5,007,376 | 4/1991 | Loverich et al. | 119/3 |
| 5,107,784 | 4/1992 | Lacy | 114/293 |
| 5,193,481 | 3/1993 | Loverich et al. | 119/3 |
| 5,398,633 | 3/1995 | Loverich et al. | 114/230 |

FOREIGN PATENT DOCUMENTS

| | | |
|---|---|---|
| 52-103198 | 8/1977 | Japan . |
| 989981 | 4/1965 | United Kingdom . |

*Primary Examiner*—Edwin L. Swinehart

*Attorney, Agent, or Firm*—Christensen, O'Connor, Johnson & Kindness

[57] ABSTRACT

A mooring system for mooring boats (20). The mooring system (10) includes buoys (12, 13), tautlines (16), a gridline (14), and anchor assemblies (18). The buoys (12, 13 ) float vertically at spaced-apart locations and are interconnected by the tautlines (16) and the gridline (14), the tautlines (16) being connected to the tops of the buoys(12, 13), and the gridline(14) being connected to the bottoms of the buoys (12, 13). The anchor assemblies (18) are attached to selected buoys (12) and urge the buoys (12, 13) apart and maintain the tautlines (16) and the gridline (14) in a taut condition. The tautlines (16) are positioned above and parallel to the water surface (22) so that boats (20) can tie up along the length of the tautlines (16).

25 Claims, 11 Drawing Sheets

TAUTLINE BOAT MOORING SYSTEM

STATEMENT OF RELATED APPLICATIONS

This application is a continuation-in-part of application Ser. No. 08/198,185, filed Feb. 17, 1994, now U.S. Pat. No. 5,398,633, issued Mar. 21, 1995.

FIELD OF THE INVENTION

This invention generally relates to systems for mooring boats and, more particularly, to systems for mooring boats in a predefined configuration.

BACKGROUND OF THE INVENTION

In the past, three types of systems have been used to moor boats. One common mooring system comprises floating docks that are held in place by anchors and/or piles. A boat is moored by tying the length of the boat alongside a section of the floating docks. There are, however, several problems associated with floating dock mooring systems. First, floating docks are generally sensitive to waves and over time tend to warp and break apart from continuous exposure to waves, particularly if the docks are made of wood. Floating docks can also be damaged by minor collisions with boats, and, in sub-freezing climates, floating docks can be damaged when the water surface freezes over. Furthermore, such docks are generally large structures so that it is difficult to install and remove the docks. If the docks are held in place with piles driven into the bottom (sea bed), the configuration of the docks is normally difficult to change without altering the piling configuration. Furthermore, floating dock mooring systems are relatively expensive and can be unsightly in appearance.

Another common mooring system consists of individual mooring buoys, held in place by anchors and anchor lines. A boat may be tied at its bow to a single buoy, or its bow may be tied to one buoy and its stern tied to a second buoy that is spaced apart from the first. While mooring systems using buoys overcome many of the problems of floating dock systems, the use of mooring buoys has other drawbacks. If the configuration employing a single buoy per boat is used, the boat will swing freely around the buoy unless the stern of the boat is anchored with an onboard anchor, which is generally time consuming to drop and properly set. Whether the stern of the boat is allowed to swing about or is secured by dropping an anchor, the position of the boat with respect to the buoy is unpredictable, i.e., the boat can be positioned radially anywhere around the buoy. As a result, such mooring buoys must be separated from other buoys by a significant distance so that moored boats will not collide. Accordingly, the maximum safe mooring density for such a configuration is relatively low. A similar problem exists with respect to a bow and stern buoy configuration because the buoys must be spaced apart sufficiently to accommodate a maximum acceptable boat length.

It is also worth noting that marina buoys or floats typically have a high degree of sensitivity to "chop,"—a type of short period wave pattern, sometimes found in marina areas, and that causes considerable discomfort and sometimes even damage to vessels and marina floats when they react to the incident chop. Consequently, the use of typical marina mooring buoys has attendant disadvantages.

A third system for mooring boats simply relies on boats dropping and setting onboard bow and/or stern anchors. The problem with the self-anchored mooring system is that the positioning of boats is not controlled and the maximum achievable safe mooring density is very low. Furthermore, it is often inconvenient and time consuming for boats to moor by dropping onboard anchors.

What is needed is a high-density mooring system that can withstand collisions from boats and continuous wave disturbances, as well as chop wave disturbances. Furthermore, the mooring system should be able to accommodate boats of widely varying lengths, should be of low cost, easy to install, reconfigure, and remove as required. Moreover, desirably the mooring system should not be unsightly.

SUMMARY OF THE INVENTION

The invention provides a boat mooring system that is stable under wave conditions normally encountered in marinas, able to withstand typical collisions with boats, and able to accommodate boats of widely varying lengths. In addition, the mooring system is of relatively low cost, easy to install, reconfigure and remove. Moreover, the mooring system is non-obtrusive and does not provide an unsightly appearance.

The boat mooring system according to the invention, includes at least two buoys, a tautline, a gridline, and at least two anchor assemblies. The buoys are adapted to float partially submerged in a body of water and are interconnected at spaced-apart locations by the tautline and gridline. Preferably, to enhance stability under chop wave conditions, the greater portion of the buoy is submerged and considerable ballast weight (mass) at the submerged end ensures that the center of gravity of the buoy is below its center of buoyancy to maintain the vertical orientation of the buoy. Further, preferably, the natural period of oscillation of the buoy is selected so that the buoy will be stable and resist displacement from its original orientation. Several shapes and designs of buoys meet this criteria, including elongated spar buoys and prism buoys, described below. According to the invention, a gridline interconnects the submerged ends of the buoys, and the tautline interconnects the upper ends of the buoys that extend above the water surface. Anchor assemblies are attached to selected buoys and are disposed to urge the buoys away from each other and maintain the tautline and gridline under tension. Thus, a boat moors to the mooring system by tying alongside a section of the tautline. Preferably, tie-offs are placed at several spaced-apart points along the tautline, so that a boat can be easily moored by securing lines between the boat and the selected tie-offs.

In one preferred embodiment, the mooring system includes at least two elongated spar buoys, a tautline, a gridline, and at least two anchor assemblies. In another, prism buoys are used instead of the elongate spar buoys. This embodiment is advantageous in shallow water areas, but can also be used in deeper waters.

In accordance with further aspects of the invention, the buoys and tautline are preferably arranged in an open configuration so that boats can tie up alongside either side of the tautline. In one preferred embodiment, the buoys and tautline are linearly arranged. In one preferred linear arrangement, two end buoys are used and at least one intermediate buoy is positioned at an intermediate point between the end buoys. In this preferred linear arrangement, anchor assemblies are attached to the end buoys to urge the end buoys apart and, together with the tautline and gridline, prevent the end buoys from moving horizontally. Anchor assemblies can also be attached to the intermediate buoy so as to prevent it from moving in a direction transverse to the tautline.

In accordance with still further aspects of the invention, a second tautline is attached to the buoys adjacent and parallel to the other tautline. In one preferred embodiment, a cross-tree is formed at the tops of the buoys for securing the tautlines on opposite sides of the buoys. When the buoys and gridline are arranged in an open configuration, boats can tie up along opposite sides of the mooring system using the respective tautlines disposed on the opposite sides.

In accordance with still further aspects of the invention, in one preferred embodiment, an anchor assembly comprises an anchor, an anchor line that attaches the anchor to a buoy, and a tom weight attached to the anchor line at a position between the buoy and anchor. When the mooring system is installed, the tom weight is suspended above the bottom (sea bed) and exerts a vertical gravitational force on the anchor line so as to keep the anchor line taut. In accordance with still further aspects of the invention, a ballast is attached to the bottom of each buoy so that the buoy's center of gravity is below its center of buoyancy, enabling the buoy to float vertically.

Another aspect of the present invention is directed to a method for providing a boat mooring system. This method comprises the steps of floating a plurality of buoys in a body of water, interconnecting upper portions of the buoys with a tautline, interconnecting lower portions of the buoys with a gridline, and anchoring the selected buoys so that the buoys are held in a particular area in the water and the tautline is above the water surface in a taut condition.

As will be appreciated from the foregoing brief summary, a mooring system for mooring boats in a predefined configuration is provided. The mooring system can withstand severe and continuous waves, including chop waves, and currents because the mooring system does not include a rigid structural frame. For this same reason, the mooring system is not easily damaged by ice or by boats colliding with the mooring system. The mooring system is able to accommodate various boat lengths because a boat can tie up along any portion of a tautline of the mooring system positioned near the water surface, and other boats can tie up to other unoccupied sections of the tautline. It will be further appreciated that only the tops of the buoys and the tautlines are visible above the water surface, so that the mooring system is not unsightly. As will be further appreciated, the mooring system can be easily configured in various shapes, such as in an "L" or "E" shape or as a series of generally parallel and spaced-apart sections, by selecting an appropriate number of buoys, appropriate tautline and gridline lengths, and appropriately positioning the anchor assemblies. Furthermore, even alter being installed, the mooring system can be easily reconfigured or removed. Finally, it will be appreciated that the mooring system is relatively inexpensive.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
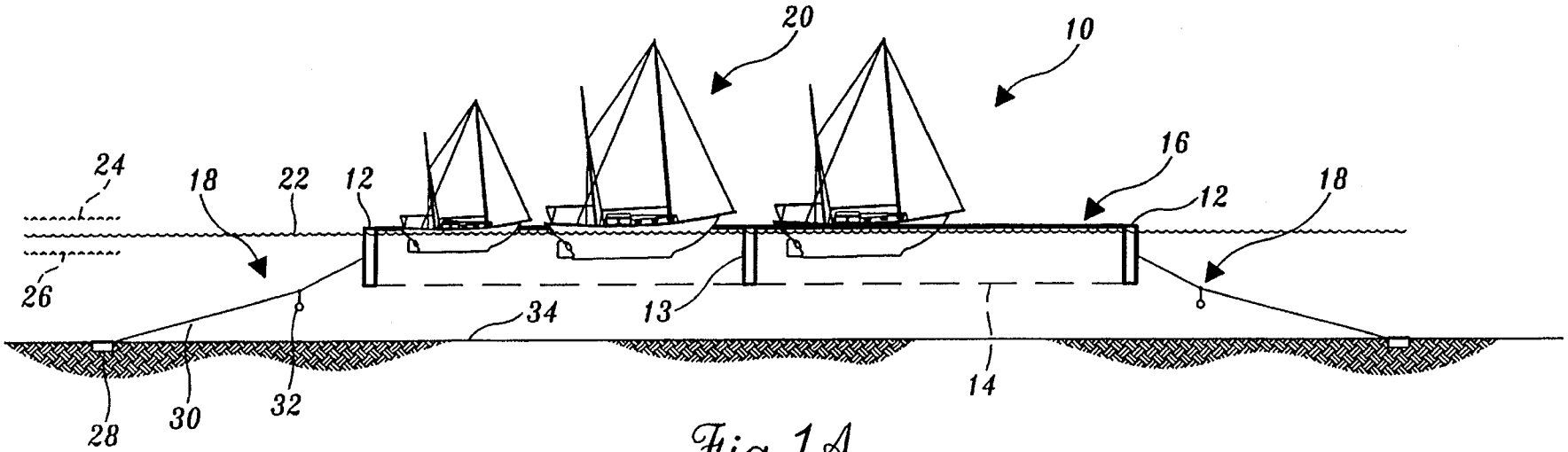
FIGS. 1A and 1B are respectively a side view and a top view of one preferred configuration of the tautline boat mooring system according to the present invention.

In accordance with the invention, a boat mooring system is provided for mooring boats in a predefined configuration. The boat mooring system, as noted above, requires the use of at least two buoys. These buoys may be of any shape and size, but preferably meet certain stability criteria. Thus, the buoys should have a limited propensity to move up and down ("oscillate") in a vertical direction ("bob") when subjected to wave action. Moreover, the buoys should resist movement out of vertical alignment ("roll") and, if moved out of vertical alignment, should return to vertical alignment in a time frame that is not disruptive of the mooring system configuration.

With regard to the propensity of the buoy to bob, the natural period of oscillation of a buoy may be represented by the equation:

$$T = 2 \cdot \pi \cdot \sqrt{\frac{M}{\rho g \cdot A}}$$

Wherein T is the period of oscillation; M is the mass of the buoy; A is the cross-sectional area of the buoy at the plane where it intersects the water surface; ρ is the density of water; and g is the gravity constant, 32 ft/sec$^2$. For a buoy to be stable, in the sense of resisting bobbing action when subjected to wave action, including chop waves, it is desirable that M be very large in relation to A. This ensures that period T is long, which is desirable for stability. Indeed, as T approaches infinity, the buoy approaches a condition of motionlessness and complete resistance to bobbing. Thus, according to the invention, buoys of large mass and small water plane area are preferred.

In order to obtain "roll stability" or a resistance to displacement in a pendulum-like side to side motion, it is desirable for the buoy to have a relatively small surface area above the water surface that is subject to impact by wave force, relative to the submerged inertial mass of the buoy. This requirement places a further constraint on buoy shape and configuration with respect to mass and ballast.

In accordance with the invention, for both bobbing and roll stability, the buoys preferably have a large mass and small water plane area as well as a small surface area subject to wave action, extending above the water surface. While a variety of buoy designs may meet these criteria, the preferred buoys are spar buoys and prism buoys. In general, spar buoys, requiring larger draft, are useful in deeper waters. On the other hand, prism buoys offer the advantage of ease of use in shallower waters, although they may also be used in deeper waters. In general, "shallower waters" are those where the restricted depth of the water limits the available draft for a spar buoy to such an extent that its advantages as used in the invention mooring systems are significantly impaired so that other buoy structures, requiring less draft, are more appropriately used.

Roll stability is further enhanced by providing suitable ballast to the submerged end of the buoy so that the center of gravity of the buoy is positioned below its center of buoyancy.

FIGS. 1–8 illustrate embodiments of the invention and, for simplicity, show the buoys as spar buoys. It will nevertheless be understood that other types of buoy may be used in the embodiments and are also within the scope of the invention as described above.

Figure 1B:
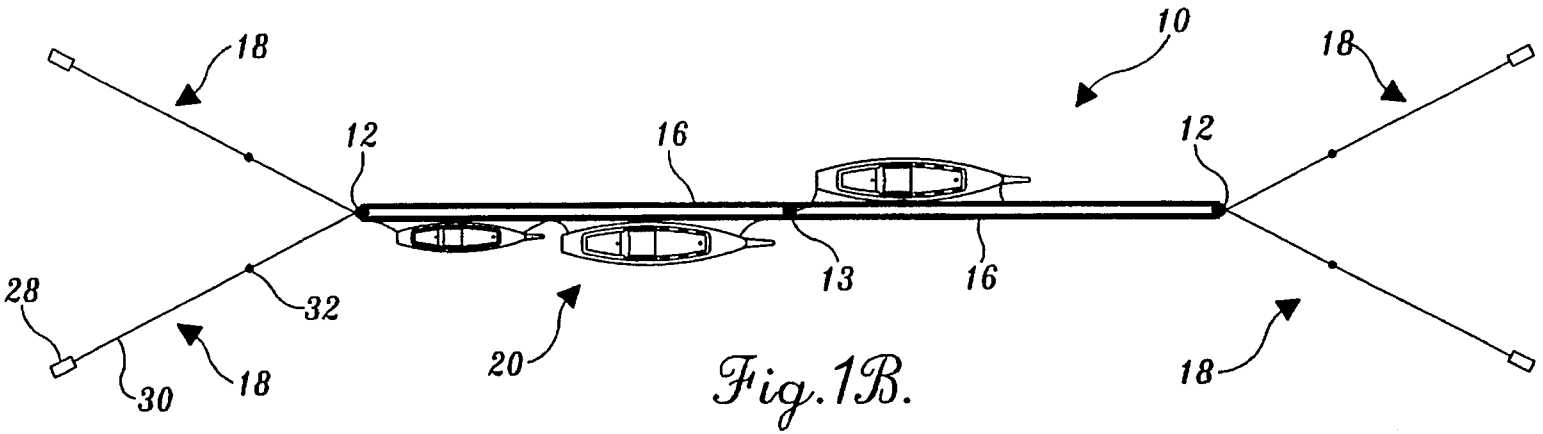

FIGS. 1A and 1B illustrate one preferred configuration of the tautline boat mooring system 10 provided by the present invention; in particular, a simple linear configuration is shown. As seen in the side view of FIG. 1A, the boat mooring system 10 includes buoys 12, 13, a gridline 14, tautlines 16, and anchor assemblies 18. In the particular preferred configuration shown, the mooring system 10 includes two end buoys 12 and an intermediate buoy 13, though it is to be understood that additional intermediate buoys 13 could be included. The bottoms of the end buoys 12 and the intermediate buoy 13 are interconnected by the gridline 14 and the tops of the buoys 12, 13 are interconnected by the tautlines 16. As seen in the top view of FIGURE 1B, the buoys 12, 13 and tautlines 16 are configured linearly, with the intermediate buoy 13 located on a substantially geometrically straight line between the end buoys 12. The anchor assemblies 18 are attached to the end buoys 12, extending downwardly to the bottom and beyond the end buoys 12 so as to urge the end buoys 12 away from each other. The tautlines 16 and gridline 14 are maintained in a taut condition by the anchor assemblies 18, even if the water surface 22 changes between a high tide 24 and a low tide 26.

As can be seen in FIG. 1B, the tautlines 16 are attached to opposite sides of the buoys 12, 13, so that boats 20 can be moored along either side of the mooring system 10 by tying up to either of the tautlines 16. Because a boat can tie up at any free section along one of the tautlines 16, the mooring system 10 can accommodate boats of various lengths. Furthermore, two boats can tie up adjacent to one another, by tying up to opposite sides of the mooring system 10, i.e., to opposite tautlines 16.

The boat mooring system 10 does not require a rigid structural frame, and as a result, the system is able to withstand severe waves and current, as well as ice and boats colliding with the mooring system. The buoys 12, 13 are elongated, e.g., cylindrical, and adapted to float vertically, as seen in FIG. 1A. The buoyancy of the buoys 12, 13 is preferably adjusted such that the tops of the buoys are above the water surface 22, thereby ensuring that the tautlines 16 are exposed above the water surface to allow a boat to easily tie up to one of the tautlines. The buoys are preferably sufficiently long so that the bottom of the buoys, and therefore the attached gridline 14, are positioned at a depth in the water below the draft of boats 20 with which the mooring system is intended to be used. As explained above, preferably, the water plane area of each buoy (i.e., the area of the cross section of the buoy taken at the water surface) is small relative to the mass of the buoy, so that the buoys remain relatively stationary even when there are minor wave disturbances on the water surface. As a result, the tautlines do not readily move with surface waves, as would be the case if the buoys were designed with a relatively large water plane area. This relative stability of the elongated buoys accordingly reduces the stresses to which the mooring system 10 is subjected. Substantially the same effect is achieved with a prism buoy which has a cross sectional area that decreases from the base (submerged) to the tip (above the water surface). Thus, the buoy cross sectional area at the water surface is small, relative to the mass of the buoy and its oscillation period, T, is large as is preferred.

Figure 2:
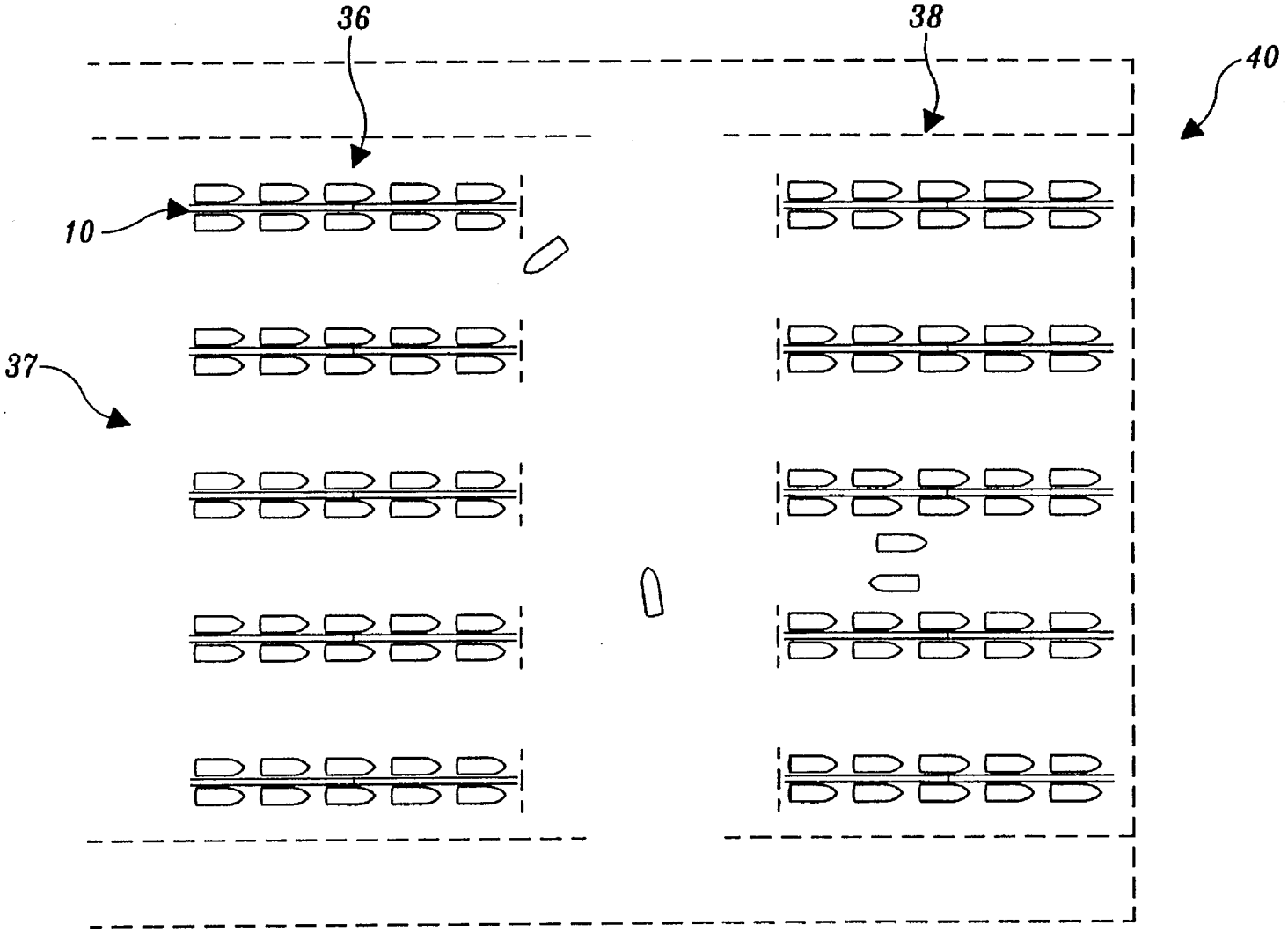
FIG. 2 illustrates one exemplary marina configuration that can be formed with the tautline boat mooring system provided by the present invention.

A series of the tautline mooring systems 10, i.e., segments, can be used to form a marina 37, as shown for example, in FIG. 2. In the illustrative marina 37 shown in FIG. 2, ten tautline boat mooring system segments 10 are arranged into two columns 36 and 38. As indicated by the dashed lines 40, a boundary line can be used to delineate the marina and define boat entry and exit paths. The boundary line 40 could be defined by a log boom, a string of floats, or using various other conventional prior art techniques and structures. Furthermore, additional segments of the tautline boat mooring system 10 could be used to define the marina perimeter by attaching visual markers, e.g., flags or surface floats, along the length of the tautline.

In addition to the particular configuration shown in FIG. 2, it will be readily appreciated that various other marina configurations can be formed using a number of tautline boat mooring system segments 10. Because a boat mooring system segment 10 can be repositioned by simply relocating the anchor assemblies 18, the marina 37 can be easily reconfigured. It will also be appreciated that while the boat mooring system segment 10 is shown to be linear, various other shapes, e.g., a C-shape, an L-shape, an E-shape, etc., can be formed, as explained in greater detail hereinafter.

Figure 3C:
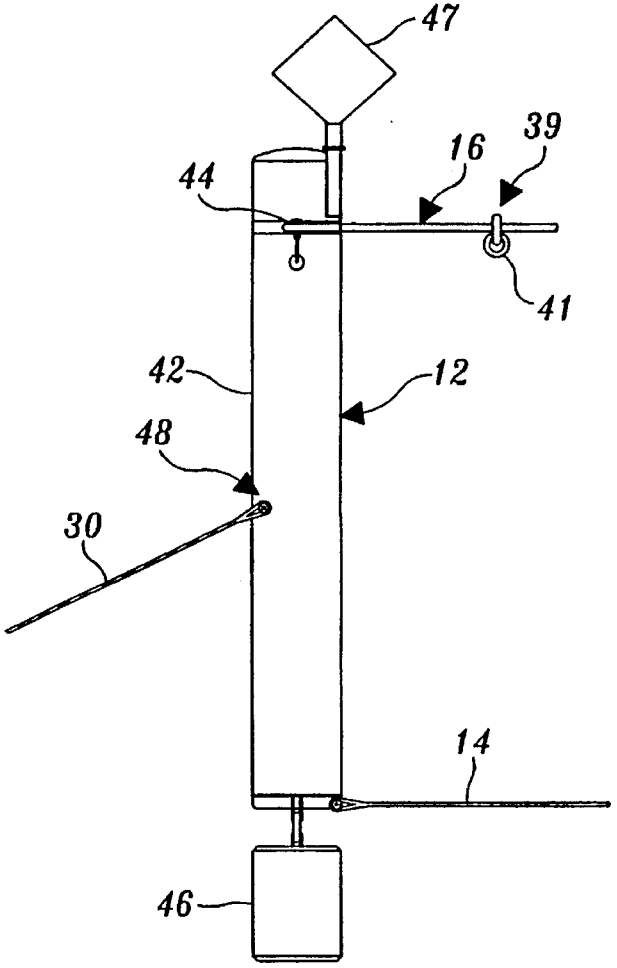
FIGS. 3A, 3B and 3C are respectively top, end and side views of an end buoy formed in accordance with the present invention.
Figure 3B:
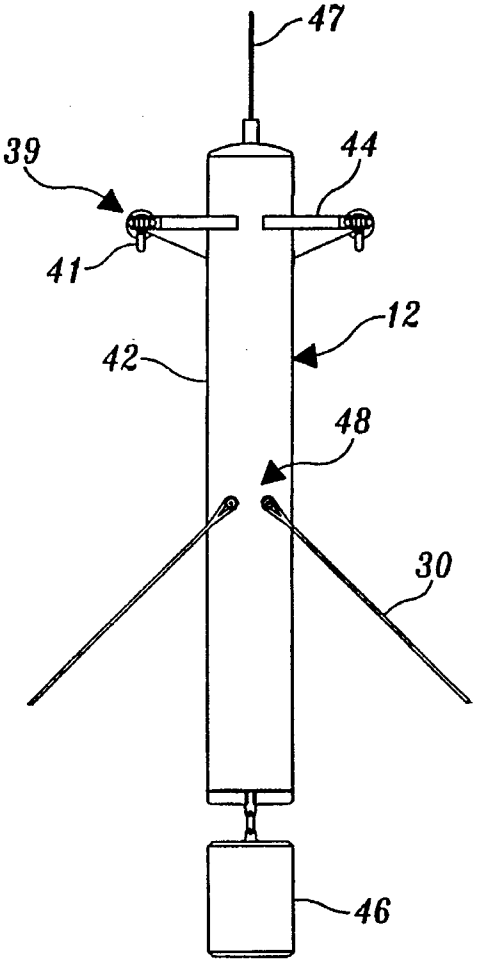
Figure 3A:
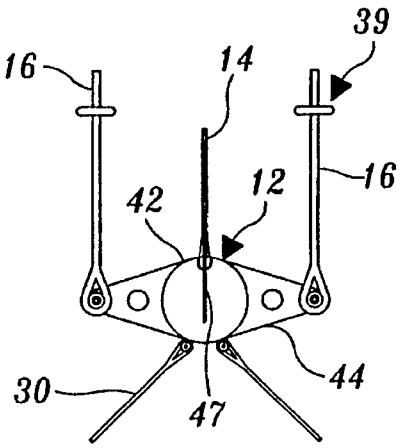

FIGS. 3A, 3B and 3C are respectively top, end and side views that illustrate the construction of an end buoy 12 in greater detail. In the preferred embodiment shown in FIGS. 3A–C, the end buoy 12 includes a cylindrical tube 42 that is capped at the top and bottom to provide a totally enclosed water-tight chamber, that is filled with air and buoyant due to the buoyant force exerted by the mass of water that it displaces. A cross-tree 44 is formed near the top of the cylindrical tube 42, and the tautlines 16 are secured to opposite ends of the cross-tree 44 so that the tautlines 16 are held to the sides of the cylindrical tube 42, as seen in FIG. 3A. The gridline 14 is attached to the bottom of the cylindrical tube 42, as seen in FIG. 3C. The center of gravity of the buoy 12 is positioned below its center of buoyancy by appropriately weighting the buoy 12. In one preferred embodiment, the center of gravity is moved below the center of buoyancy by attaching a ballast 46 to the bottom of the cylindrical tube 42, as shown in FIGS. 3B and 3C. However, it will be readily appreciated that the buoys 12 can be weighted in various other fashions to achieve the desired spatial relationship between the center of buoyancy and the center of gravity. If desired, signage 47, as illustrated in FIG. 3C, can be attached on top of the cylindrical tube 42.

Tie-offs 39 as shown in FIG. 3C are preferably attached at several spaced-apart locations along the lengths of the tautlines 16. In this preferred embodiment, each tie-off 39 includes a ring 41 that forms an eye through which lines, i.e., ropes, can be passed. Any of the boats 20 are tied to the tautline 16 by securing one end of a line (not shown in this Figure) to the boat, passing the other end of the line through the ring 41 of the tie-off 39, and then securing that other end of the line to the boat.

The anchor assemblies 18 maintain the tautlines 16 and gridline 14 in a taut state even when the level of the water surface 22 changes, e.g., due to tidal changes between the high tide level 24 and the low tide level 26. In the preferred embodiment shown in FIGS. 1A and 1B, each anchor assembly 18 includes an anchor 28, an anchor line 30 and a tom weight 32. The anchor 28 is secured to the bottom or sea bed 34 and the anchor line 30 is attached at one end to the anchor 28 and at the other end to one of the end buoys 12. The tom weight 32 is attached to the anchor line between the anchor 28 and the buoy 12 so that the tom weight 32 is suspended in the water above the sea bed. As shown in more detail in FIG. 5, the tom weight 32 exerts a downward vertical force on the anchor line 30 that keeps the anchor line under tension as the buoys 12 move vertically with tidal changes. In particular, by locating the anchor 28 a distance beyond the end buoy 12, the anchor assembly 18 exerts a backward force on the end buoy 12 that keeps the tautlines 16 and gridline 14 under tension.

In the preferred embodiment shown in FIGS. 1A and 1B, two anchor assemblies 18 are attached to each of the end buoys 12. As seen in FIG. 1B, the two anchor assemblies 18 attached to one of the end buoys 12 are located a distance beyond and spaced apart, on opposite sides of the end buoy 12 defining an included angle of about 25° to 50° that is generally centered relative to the gridline 14. This preferred placement of the anchor assemblies 18, in combination with the tension in the tautlines 16 and gridline 14, prevents the end buoy 12 from moving horizontally. Preferably, as shown in FIGS. 3B and 3C, the anchor lines 30 are attached to a middle section 48 of the cylindrical tube 42 of the end buoy 12 so that the backward force exerted on the cylindrical tube 42 is distributed between the tautline 16 and the gridline 14. The backward force exerted on the end buoy 12 is preferably sufficiently great to keep the tautline 16 disposed above the water surface along its entire length. This backward force is achieved by appropriately choosing the volume and mass of the tom weights 32. To ensure that the tautlines 16 remain above the water surface, surface floats (not shown) could also be attached at intervals along the lengths of the tautlines 16. The surface floats would also improve visibility of the tautlines.

It will also be appreciated that tensioning assemblies other than tom weights 32 can be used to provide sufficient tension in the anchor lines 30. For example, in place of the tom weights 32, an auxiliary float (not shown) could be attached to the anchor line 30 so that it remains submerged in the water. The buoyancy of the auxiliary float would then create tension in the anchor line 30 by exerting an upward force on the anchor line. Furthermore, a tom weight 32 and an auxiliary float could be both attached to the anchor line 30 at different positions, e.g., by placing the tom weight 32 between the anchor 28 and the auxiliary float, so as to exert both upward and downward forces on the anchor line sufficient to keep the anchor line under the required tension. Furthermore, a helical spring assembly (not shown) of sufficient length and spring constant to maintain a relatively constant tension in the anchor line 30 could be attached between the anchor line 30 and the anchor 28.

Figure 4C:
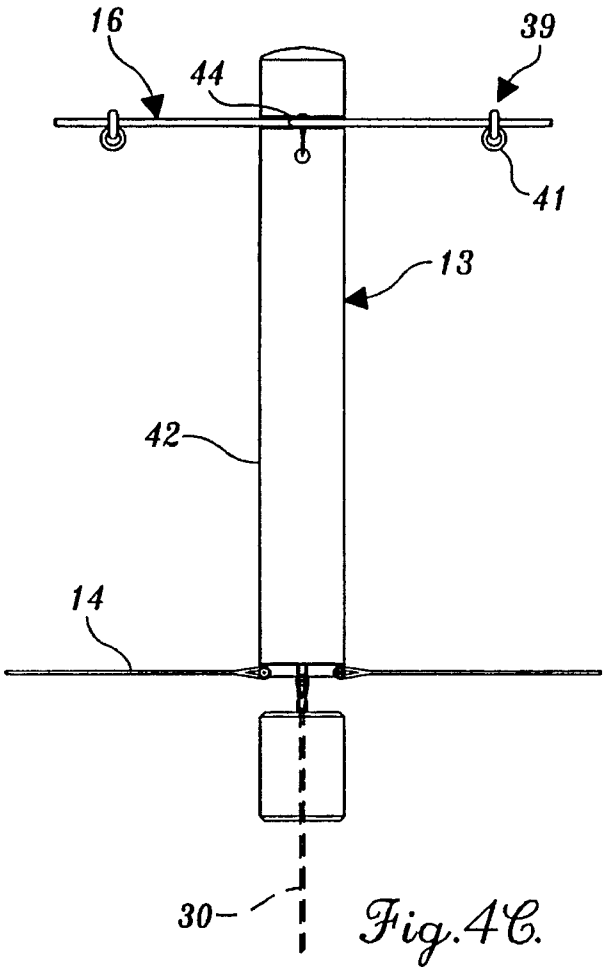
FIGS. 4A, 4B and 4C are respectively top, end and side views of an intermediate buoy formed in accordance with the present invention.
Figure 4B:
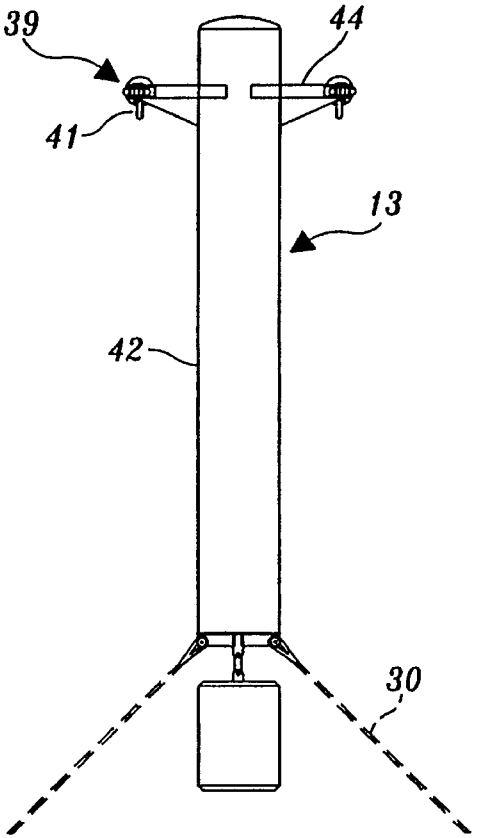
Figure 4A:
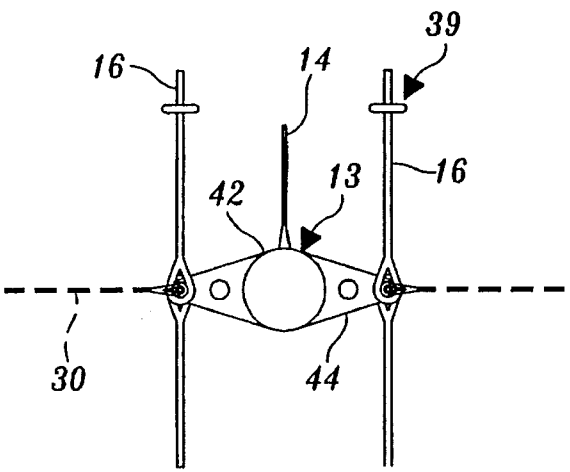
Figure 5:
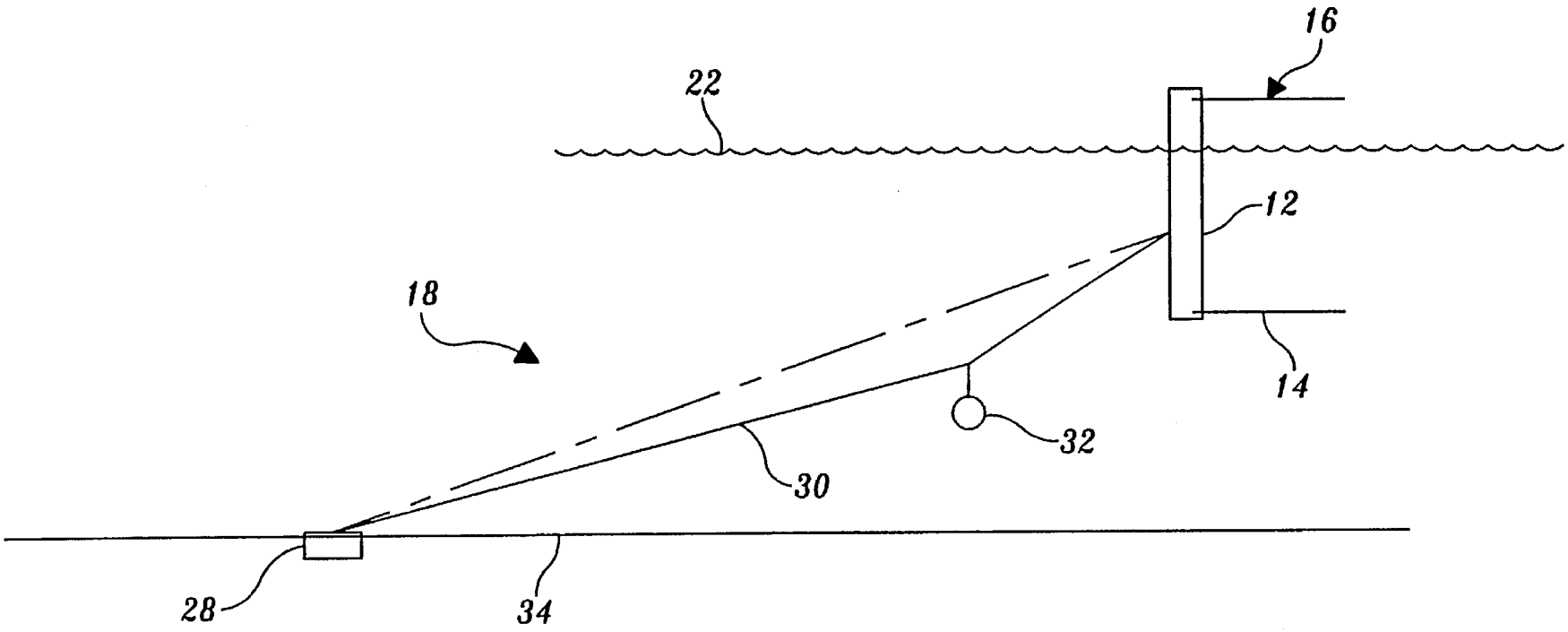
FIG. 5 is a side view of an end buoy when installed with one preferred form of an anchor assembly according to the present invention.

FIGS. 4A, 4B and 4C provide, respectively, top, end and side views of an intermediate buoy 13. The structure of the intermediate buoy 13 is similar in many ways to the end buoy 12 shown in FIGS. 3A–C and, accordingly, only the unique features of the intermediate buoy 13 will be described. As the intermediate buoy 13 is positioned between the end buoys 12, the tautlines 16 and the gridline 14 extend away from the intermediate buoy 13 in diametrically opposite directions. In one preferred embodiment, the gridline 14 and the tautlines 16 are formed in separate segments, as shown in FIGS. 4A and 4C, each segment interconnecting two buoys.

While an anchor assembly attached to the intermediate buoy 13 is not shown in FIG. 1A, it should be apparent that anchor assemblies 18 can be attached to the intermediate buoy 13 to prevent the intermediate buoys from moving laterally, i.e., transversely relative to the tautlines 16. The anchors 28 for these anchor assemblies would be located on opposite sides of the buoy 13, i.e., extending laterally away from the tautlines 16 and gridline 14. Preferably, as shown in FIG. 4B, the anchor lines 30 would be attached to the bottom of the cylindrical tube 42, at a depth sufficiently below the keel of boats using the tautline mooring system 10 so as to not interfere with the passage of those boats. One situation in which anchor assemblies 18 are preferably attached to intermediate buoys 13 is where the mooring system 10 is intended to be used with larger boats that subject the intermediate buoys to substantial lateral forces.

It is also contemplated that anchor assemblies 18 would be used with intermediate buoys if a non-linear configuration is desired for the tautline boat mooring system 10. For example, if a C-shape mooring system (not shown) is desired, several buoys 12, 13 would be interconnected with tautlines 16 and a gridline 14, and an appropriate number of anchor assemblies 18 would be attached to the buoys and positioned with the anchors 28 disposed radially outward of the curved loop to create the desired C-shape.

Commonly available materials can be used to form the various components of the tautline boat mooring system 10. Preferably, the lines, e.g., the tautlines 16, the gridline 14, and the anchor lines 30, are formed of braided plastic strands, of a type of plastic selected for its resistance to ultraviolet rays, temperature extremes and water exposure, such as polypropylene plastic. The tautlines 16 are preferably of a sufficiently large diameter so that they act like a bumper, i.e., exert little pressure on the sides of the moored boats 20 to prevent damage to the boats. Optionally, the tautlines could be padded. Instead of using a synthetic rope for the various lines, a metal chain or cable could be used. In one preferred embodiment, the buoys 12, 13 are formed of steel, however, plastic, as well as other materials, could be used. The ballast 46 attached to the bottom of the cylindrical tube 42 of the buoys 12, 13 is cast of concrete in one preferred embodiment, however, other materials, such as steel or lead, could also be used. Similarly, the anchors 28 and tom weights 32 can be formed of steel, lead, concrete, or other materials of sufficient density.

Figure 6B:
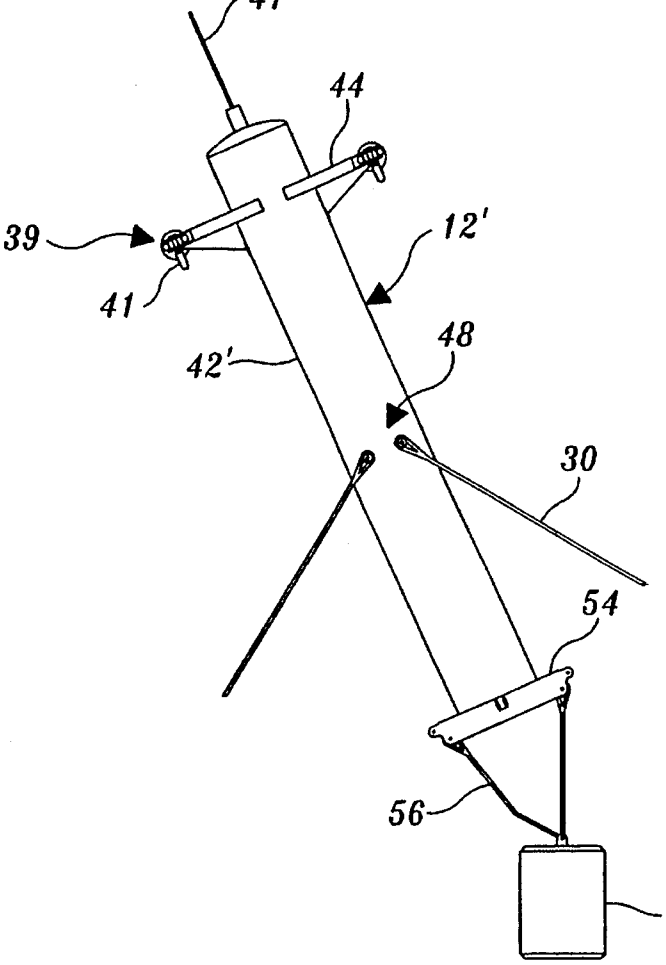
FIGS. 6A and 6B are end views of an alternative form of an end buoy according to the present invention.
Figure 6A:
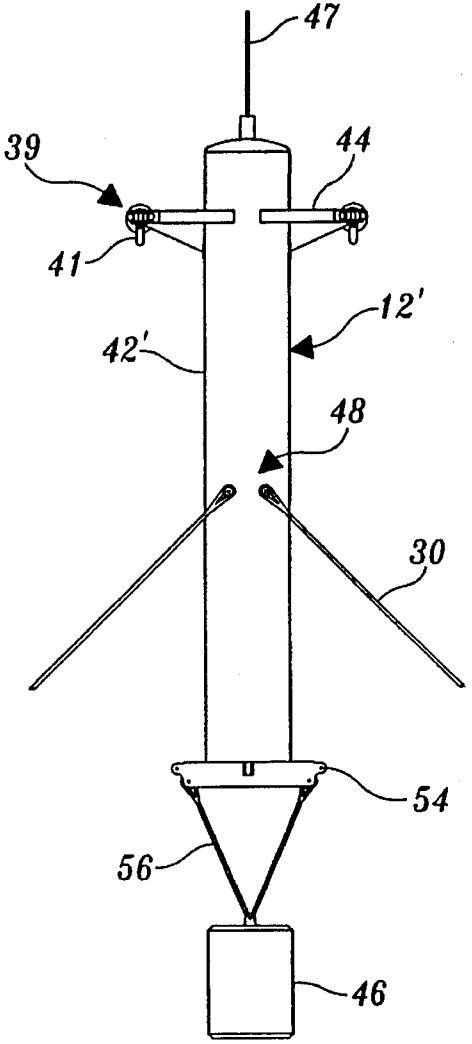

Various further changes can be made to the structure described up to this point. For example, as shown in FIGS. 6A and 6B, the interconnection between the ballast 46 and the buoy can be modified so as to increase the stability of the buoy. FIGS. 6A and 6B show an end view of an alternative end buoy 12' that includes a bottom cross-tree 54, to which the ballast 46 is attached by lines 56. In particular, the cross-tree 54 is formed on the bottom of the buoy 12'. Two lines 56 are attached at one end to the ballast 46, and the other ends of the lines 56 are attached to opposite sides of the cross-tree 54. The advantage of connecting the ballast 46 in this manner is that the buoy 12' is more resistant to tilting. As illustrated in FIG. 6B, when the buoy 12' tilts from its normal vertical alignment, the majority of the weight of the ballast 46 is transferred to one of the lines 56 and the corresponding side of the cross-tree 54 so as to exert a righting moment on the buoy 12', tending to force the buoy back to its vertical alignment. More specifically, when the buoy 12' tilts, the weight of the ballast 46 is transferred to the side of the cross-tree 54 that rises as the buoy 12' tilts.

Figure 7:
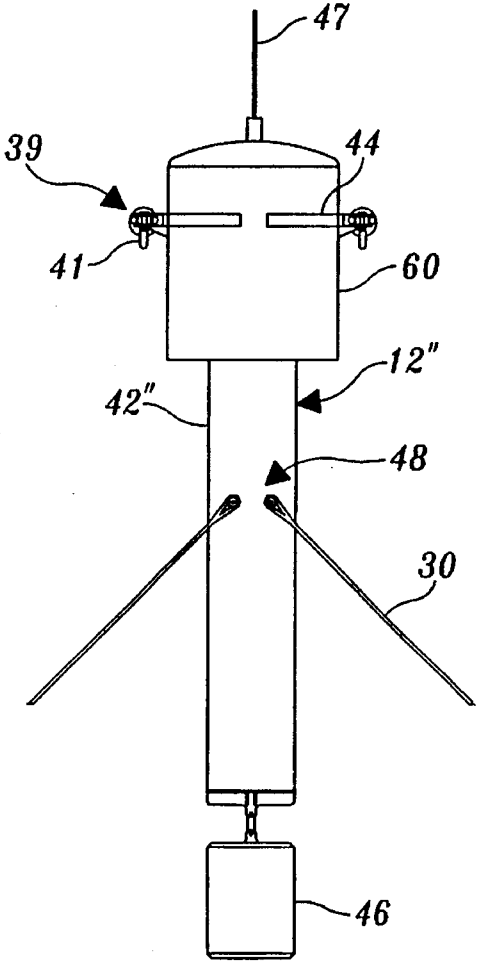
FIG. 7 is an end view of another alternative form of an end buoy according to the present invention.

FIG. 7 illustrates another alternative buoy design that increases the buoy's resistance to tilting. The end buoy 12" shown in the end view of FIG. 7 has a cylindrical tube 42" that has an upper section 60 that is wider in diameter than the rest of the cylindrical tube 42". By increasing the diameter of the upper section 60 of the cylindrical tube 42", the center of buoyancy of the buoy 12" is raised further above the center of gravity of the buoy 12". Increasing the distance between the center of buoyancy and the center of gravity in this manner increases the righting moment generated by the spaced-apart center of buoyancy and center of gravity when the buoy 12" tilts. Accordingly, the buoy 12" is more resistant to tilting.

As described hereinabove, for use in deeper waters the buoys are preferably elongated, such as spar buoys, and of such a length that the bottom of each buoy is below the bottoms of the boats 20 with which the tautline boat mooring system is formed to be used. If the tautline boat mooring system is installed in shallow waters, it will be readily understood that the buoys will either have to be shorter so as not to hit the sea bed, or be of the preferred prism type. As the length of a buoy is decreased, the diameter of the buoy may have to be increased to provide sufficient buoyancy.

Figure 8:
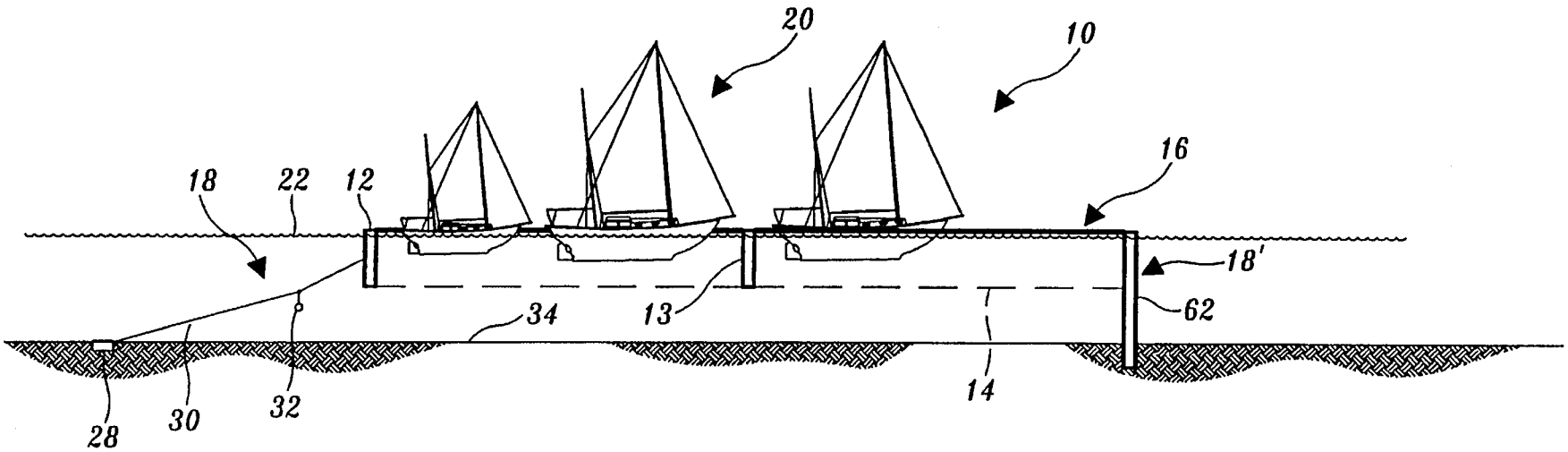
FIG. 8 is a side view of an alternative form of the tautline boat mooring system according to the present invention.

Another alternative design is illustrated in the side view of FIG. 8. FIG. 8 illustrates an alternative anchor assembly 18' for securing one end of the tautline boat mooring system 10. The alternative anchor assembly 18' shown in FIG. 8 simply comprises a piling that is driven vertically into the bottom or sea bed 34, with the top of the piling positioned above the water surface 22. Instead of attaching the ends of the tautline 16 and the gridline 14 to two end buoys 12, one end of each of the tautlines 16 and gridline 14 are attached to an end buoy 12, and the other end of each of the tautlines 16 and gridline 14 are attached to the piling 62 of the anchor assembly 18', instead of a second end buoy 12. This configuration is most practical in lakes where the water surface level does not change significantly. The anchor assembly 18' could be formed with various stationary structures other than the piling 62. For example, the tautlines 16 could be secured to shore and the gridline 14 could be secured to the bottom 34 near shore at a point where the depth of the bottom 34 is level with the bottom of the end buoy 12.

Figure 9:
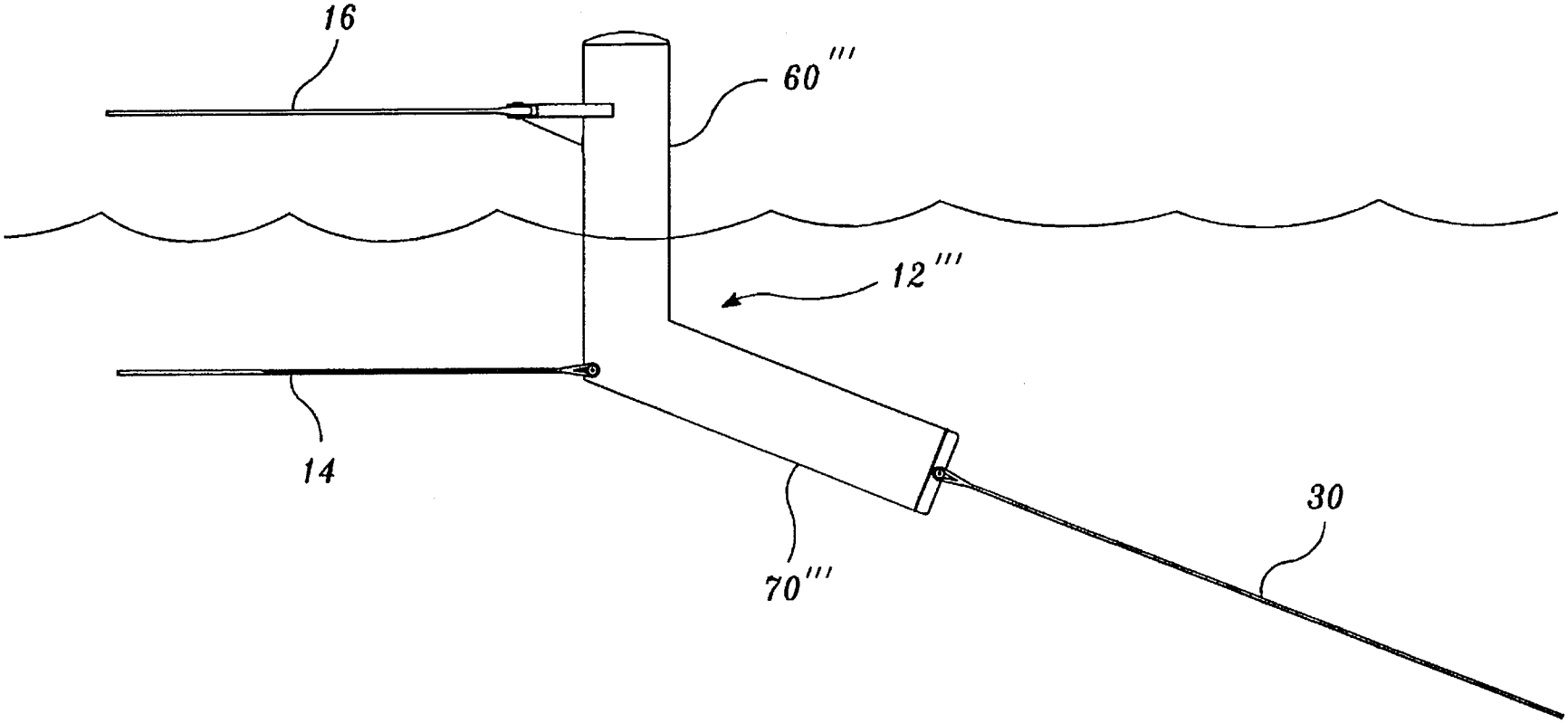
FIG. 9 is a side view of an alternative form of an anchored buoy according to the invention.

FIG. 9 illustrates another alternative buoy design that provides improved stability in wave conditions. The end buoy 12''' shown in side view has a vertically oriented cylindrical tube upper portion 60''' and a cylindrical lower portion 70''', of substantially the same diameter as the upper portion and angled to the upper portion at an angle that approximates the angle of the anchor line 30. The angled lower portion 70''' may optionally carry internal ballast.

Figure 10:
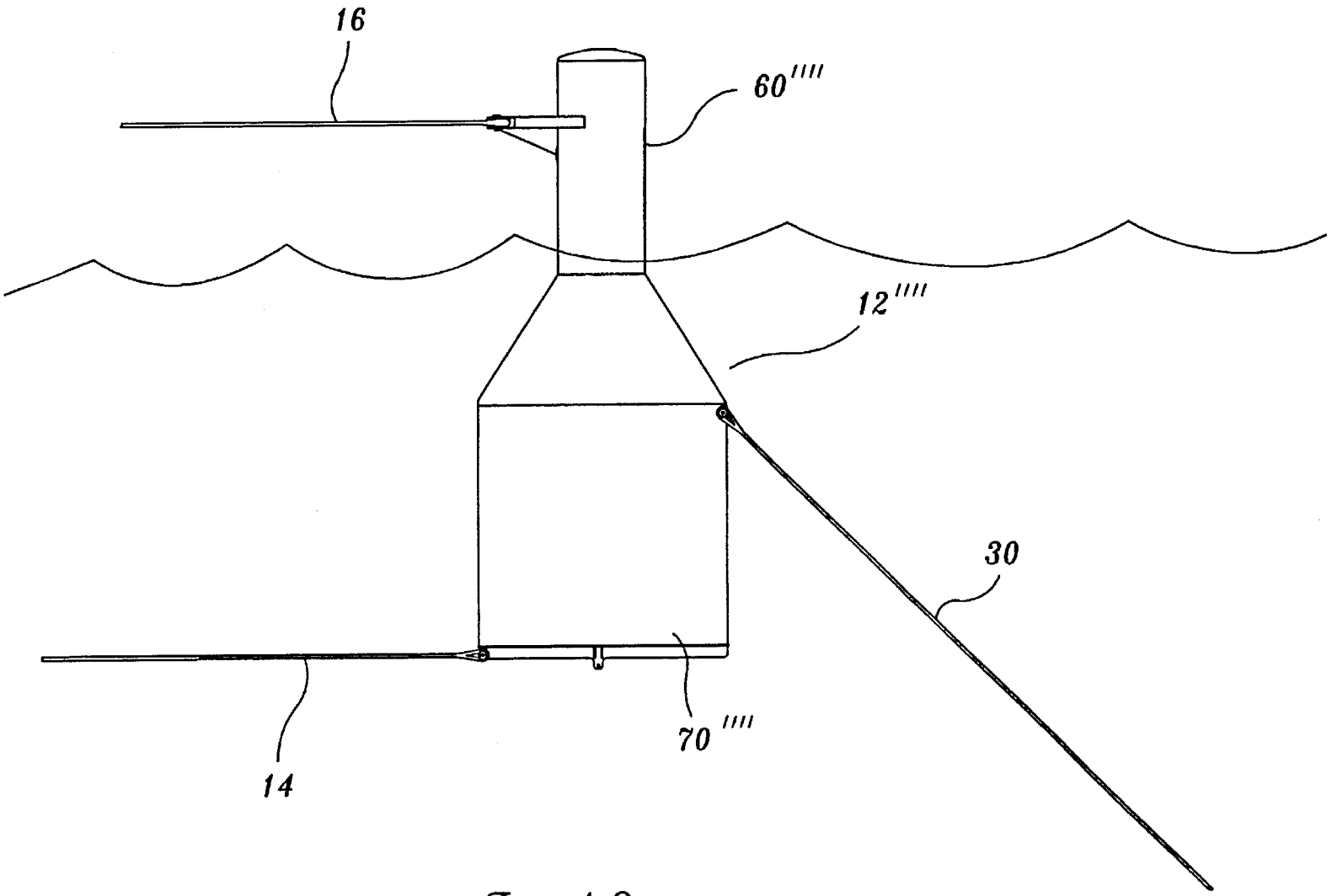
FIG. 10 is a side view of an anchored spar buoy with internal ballast according to the invention.

FIG. 10 illustrates yet another alternative spar buoy design for increased stability. The end buoy 12'''' shown has an upper cylindrical portion 60'''' of a first, smaller diameter that flares outward at its base to a larger diameter lower portion 70''''. The lower portion may carry internal ballast so that the center of gravity of the buoy is below the center of buoyancy.

Figure 11:
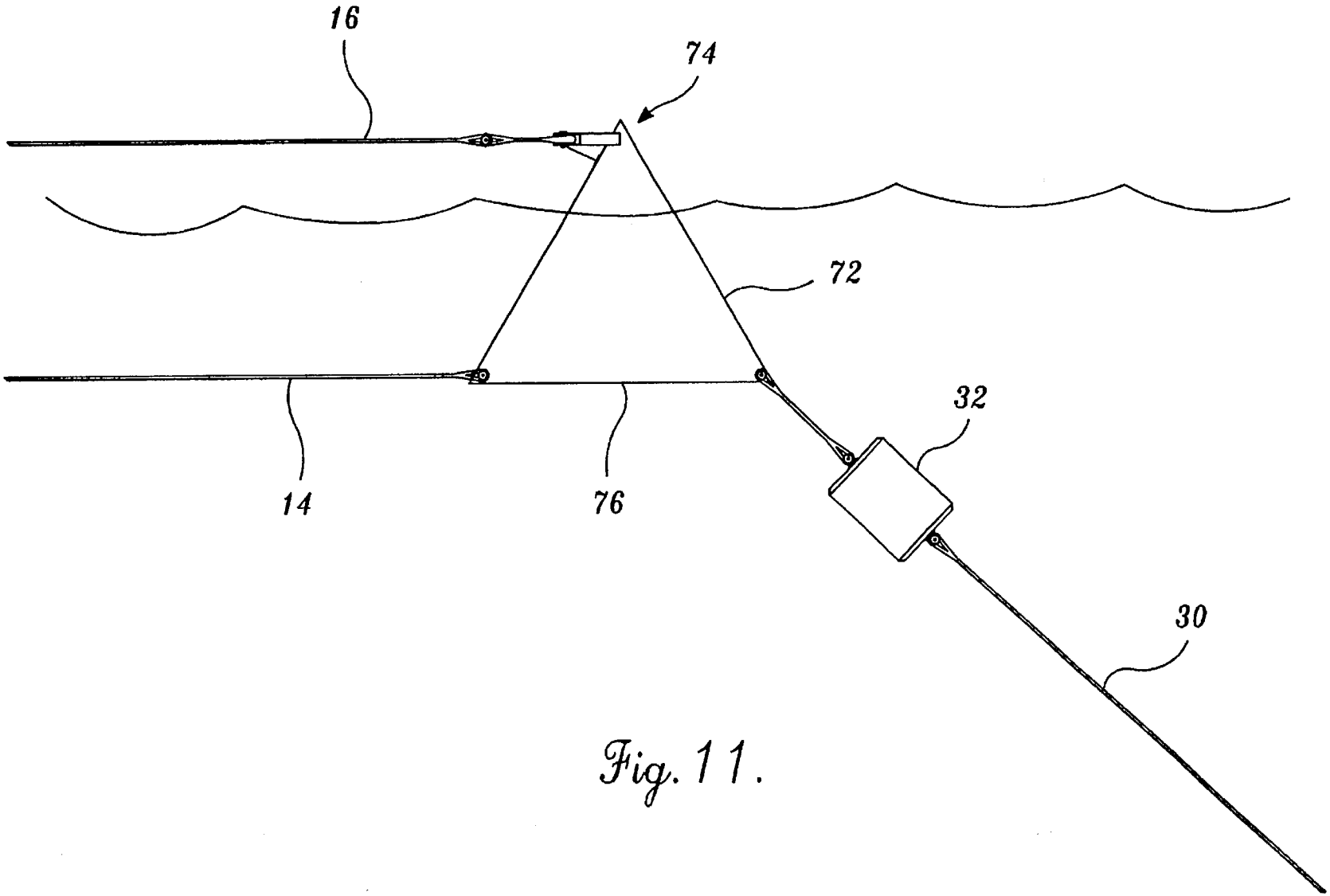
FIG. 11 is a side view of a prism buoy, anchored and with external ballast, according to the invention.

FIG. 11 is an illustration of one of the preferred buoys, especially for use in shallower waters, a prism buoy 72. The apex 74 of the prism buoy is above the water surface and has secured thereto a tautline 16. The base 76 of the prism is submerged and has attached thereto the gridline 14. As explained above, these buoys provide a small water plane area relative to their mass. However, to further increase the mass of the assembly, a tom weight 32 may be secured to a point near the base 76 of the buoy, to which an anchor line 30 is in turn attached. Such a buoy and tom weight assembly provides exceptional roll stability and is relatively free of undesirable oscillation.

As will be readily appreciated from the foregoing discussion, the present invention provides a relatively high density boat mooring system that can accommodate boats of widely varying lengths, can withstand severe waves and current, is easily installed, reconfigured and removed, is not easily damaged by boats, and is relatively low cost. Furthermore, the tautline boat mooring system 10 is not unsightly because the only visible components of the mooring system are the tops of the buoys 12, 13 and the tautlines 16. The visibility of the mooring system can be further reduced during periods of nonuse, e.g., during the winter seasons, by removing the tautlines 16. With the tautlines 16 removed, the buoys would remain in place, held by the anchor assemblies 18 and the gridline 14. In addition to reducing the visibility of the mooring system, removing the tautline 16 allows boats to pass freely between the buoys. Furthermore, with the tautlines 16 removed, the mooring system would be better able to withstand freezing of the water surface because the buoys would be able to move more freely.

While the presently preferred embodiment of the invention has been illustrated and described, along with various alternatives thereto, it will be appreciated that further changes can be made thereto. Accordingly, the spirit and scope of the invention is not limited by the disclosure, but should instead be determined entirely by reference to the claims that follow.

The embodiments of the invention in which an exclusive property or privilege is claimed are defined as follows:

1. A boat mooring system comprising:

(a) first and second buoys, each adapted to float in a body of water, each buoy having an upper section and a lower section;

(b) a tautline interconnecting said upper sections of said first and second buoys, said first buoy being secured to one end of said tautline, said second buoy being secured to the other end of said tautline;

(c) a plurality of tie-offs secured at spaced-apart points along the tautline, the tie-offs adapted for mooring boats alongside the tautline;

(d) a gridline interconnecting said lower sections of said first and second buoys; and (e) a first anchor assembly and a second anchor assembly, said first anchor assembly being attached to said first buoy and said second anchor assembly being attached to said second buoy so as to urge said first and second buoys away from each other and maintain said tautline in a taut condition adjacent the surface of the body of water when said boat mooring system is installed in the body of water.

2. The boat mooring system of claim 1 wherein the first and second buoys each have a center of gravity below the center of buoyancy of the buoy.

3. The boat mooring system of claim 1 wherein the first and second buoys are spar buoys.

4. The boat mooring system of claim 1 wherein the first and second buoys are prism buoys.

5. The boat mooring system claim 1, wherein the tie-offs each comprise a ring with an eye, the tautline extending through the eye of the ring.

6. A boat mooring system comprising:

(a) plurality of buoys, said plurality of buoys including a first buoy and a second buoy, each of said plurality of buoys being adapted to float in a body of water and having an upper section and a lower section;

(b) a tautline securely interconnecting said upper sections of said plurality of buoys;

(c) a plurality of tie-offs secured at spaced-apart points along the tautline, the tie-offs adapted for mooring boats alongside the tautline;

(d) a gridline securely interconnecting said lower sections of said plurality of buoys; and (e) a first anchor assembly and a second anchor assembly, said first anchor assembly being attached to said first buoy and said second anchor assembly being attached to said second buoy so as to urge said first and second buoys away from each other and maintain said tautline in a taut condition adjacent the surface of the body of water when said boat mooring system is installed in the body of water.

7. The boat mooring system of claim 6, wherein said tautline extends substantially linearly between said first and said second buoys, said buoys disposed at opposite ends of said tautline.

8. The boat mooring system of claim 7, wherein said plurality of buoys include a third buoy interposed between said first and second buoys and interconnected with said tautline and said gridline.

9. The boat mooring system of claim 8, further including a third anchor assembly secured to said third buoy to prevent said third buoy from moving in a direction transverse to said tautline.

10. The boat mooring system of claim 9, wherein said third anchor assembly includes an anchor line attached to the lower section of said third buoy.

11. The boat mooring system of claim 6, further including a second tautline adjacent and parallel to said tautline, said tautline and said second tautline being attached to opposite sides of each of said plurality of buoys, enabling a first boat to be moored to said tautline opposite a second boat that is moored to said second tautline.

12. The boat mooring system of claim 11, wherein said plurality of buoys each includes a cross-tree proximate said upper section for securing said tautline and said second tautline on the opposite sides of the buoy.

13. The boat mooring system of claim 12, further including a third anchor assembly secured to said first buoy, said first and third anchor assemblies extending generally toward opposite sides of said first buoy, so that said first and third anchor assemblies cooperate with said tautline and said gridline to resist horizontal movement of said first buoy.

14. The boat mooring system of claim 6, further including a third anchor assembly attached to said first buoy, said first and third anchor assemblies extending generally toward opposite sides of said first buoy, so that said first and third anchor assemblies cooperate with said tautline and said gridline to resist horizontal movement of said first buoy.

15. The boat mooring system of claim 14, wherein said first and third anchor assemblies each comprise:

an anchor;

an anchor line attached to and extending between said anchor and said first buoy; and a tom weight attached to a section of said anchor line intermediate the anchor and the buoy and positioned above and off the floor of the body of water for maintaining tension in said anchor line.

16. The boat mooring system of claim 15, wherein said first buoy includes a middle section intermediate said upper and lower sections and wherein said anchor lines are attached to said middle section of said first buoy.

17. The boat mooring system of claim 6, further including a plurality of tie-offs attached at spaced-apart points along said tautline, said tie-offs being adapted to secure boats to said tautline.

18. The boat mooring system of claim 6, wherein each of said plurality of buoys includes a separate ballast secured to the lower section of the buoy.

19. The boat mooring system of claim 18, wherein the center of gravity of each of said plurality of buoys is below its center of buoyancy.

20. The boat mooring system of claim 18, further including two ballast lines attaching said ballast to opposite sides of the lower section of the buoy, so that when the buoy tilts, the weight of said ballast is transferred to the side of the lower section of the buoy that rises, so as to exert a righting moment on the buoy that tends to force the buoy back to a vertical alignment.

21. The boat mooring system of claim 6, wherein said upper section of each of said plurality of buoys has a larger cross-sectional area than said buoy lower section, so as to increase the resistance of each of said plurality of buoys to tilting.

22. The boat mooring system of claim 6, wherein the tie-offs each comprise a ring with an eye, the tautline extending through the eye of the ring.

23. A boat mooring system comprising:

(a) a plurality of buoys adapted to float in a body of water, each having a lower section and an upper section;

(b) a gridline interconnecting said lower sections of said plurality of buoys at spaced-apart locations along said gridline;

(c) a tautline interconnecting said upper sections of said plurality of buoys at spaced-apart locations along the length of the tautline;

(d) a plurality of tie-offs secured at spaced-apart points along the tautline, the tie-offs adapted for mooring boats alongside the tautline;

(e) an anchor assembly, attached to at least two of said plurality of buoys, for urging said buoys away from each other and maintaining said buoys in a substantially linear arrangement in a body of water.

24. The boat mooring system of claim 23, wherein the tie-offs each comprise a ring with an eye, the tautline extending through the eye of the ring.

25. A method for providing a boat mooring system comprising the steps of:

(a) floating a plurality of buoys in a body of water, at spaced-apart locations defining a desired configuration, said configuration having opposite ends at which a first buoy and a second buoy are respectively disposed;

(b) interconnecting upper portions of said plurality of buoys projecting above the surface of the body of water with a first tautline and a second tautline, said first buoy being disposed at one end of each said tautlines and said second buoy being at an opposite end of each of said tautlines;

(c) interconnecting submerged lower portions of said plurality of buoys with a gridline; and (d) anchoring at least said first and second buoys so as to:

(i) urge said first and second buoys away from each other;

(ii) maintain said first and second tautlines taut; and (iii) hold said plurality of buoys in a particular area in the body of water; and (e) providing tie-offs at spaced-apart points on the lengths of the first and second tautlines for mooring boats.

* * * * *